United States Patent [19]

Hutchins et al.

[11] 4,100,095

[45] Jul. 11, 1978

[54] PEROXYACID BLEACH COMPOSITION HAVING IMPROVED EXOTHERM CONTROL

[75] Inventors: James Peyton Hutchins, Springfield Township, Hamilton County; Donald Victor Julian, Colerain Township, Hamilton County; Michael Eugene Burns, Union Township, Butler County, all of Ohio

[73] Assignee: The Procter & Gamble Company, Cincinnati, Ohio

[21] Appl. No.: 718,282

[22] Filed: Aug. 27, 1976

[51] Int. Cl.[2] ..... C11D 7/18

[52] U.S. Cl. ..... 252/99; 252/95; 252/100; 252/186; 260/502 R

[58] Field of Search ..... 252/95, 99, 100, 186; 260/502 R

[56] References Cited

U.S. PATENT DOCUMENTS

| | | | |
|---|---|---|---|
| 3,639,285 | 2/1972 | Nielson | 252/100 |
| 3,770,816 | 11/1973 | Nielson | 260/502 R |
| 3,956,159 | 5/1976 | Jones | 252/99 |
| 3,970,578 | 7/1976 | Datlow | 252/186 |

FOREIGN PATENT DOCUMENTS

| | | |
|---|---|---|
| 814,938 | 11/1974 | Belgium. |

*Primary Examiner*—Mayer Weinblatt

*Attorney, Agent, or Firm*—George M. Kaplan; Douglas C. Mohl; Richard C. Witte

[57] ABSTRACT

Organic peroxyacid compounds are stabilized against excessive heat generation as the result of exothermic decomposition by the addition of a nonhydrated material which chemically decomposes to start releasing water at a temperature below the acid's decomposition temperature.

6 Claims, No Drawings

PEROXYACID BLEACH COMPOSITION HAVING IMPROVED EXOTHERM CONTROL

BACKGROUND OF THE INVENTION

The present invention relates to a dry, stable bleaching composition comprising a peroxyacid compound and a compound which releases water by means of chemical decomposition.

Peroxygen bleaching agents in general and peroxyacid compounds in particular have long been recognized as effective bleaching agents for use when the adverse color and fabric damage effects of harsh active halogen bleaching agents cannot be tolerated. See, for example, Canadian Patent No. 635,620, Jan. 30, 1962, to McCune. However, utilization of these materials poses several problems. One of the problems is that organic peroxyacids decompose spontaneously releasing heat. At a certain temperature, called the self-accelerating decomposition temperature, a runaway reaction can occur which could lead to the generation of sufficiently high temperature to ignite the organic peroxyacid. This decomposition can be initiated by both point sources of heat, such as friction, or the entire sample could reach the decomposition temperature during storage or shipping.

There have been many ways suggested for controlling the exothermic reaction of peroxyacid compounds. The most prevalant method has involved the addition of a preferably neutral or slightly acidic inorganic salt hydrate to the peroxy compounds. The hydrated salts were selected to that some of the waters of hydration would be released at a temperature slightly below the decomposition temperature of the acid. Hydrated materials used include magnesium sulfate, calcium sodium sulfate, magnesium nitrate, potassium aluminum sulfate and aluminum sulfate. These and many others are disclosed in U.S. Pat. No. 3,770,816, Nov. 6, 1973, to Nielsen.

While the above-mentioned hydrated materials are able to supply water to quench the exothermic reaction, they suffer from several defects. These include the following:

1. The hydrated salts maintain sufficient vapor pressure of water in the presence of the diperoxyacid to increase the loss of available oxygen.
2. The loss of water to the surroundings due to high vapor pressure reduces the amount of exotherm control.
3. Many of the hydrated salts contain high levels of metal ions which increase the loss of available oxygen, reduce the shelf life of the final product and injure the cleaning performance of compositions containing the diperoxyacids.

These defects cause the formulator of dry peroxyacid products several problems and a better exotherm control mechanism is desirable.

It has been found in the present invention that a better exotherm control measure is obtained by adding a material which will chemically decompose to release water to the environment in which the peroxyacid exists. These agents not only supply all of the benefits of hydrated salts but additionally overcome the aforementioned problems.

Accordingly, it is an object of the present invention to provide a composition containing a peroxyacid compound having improved exothermic control.

This and other objects will become apparent from the description which follows.

As used herein, all percentages and ratios are by weight unless otherwise specified.

SUMMARY OF THE INVENTION

The present invention encompases a composition comprising a peroxyacid compound and as an exotherm control agent a nonhydrated material which chemically decomposes to start to release from about 200% to about 500% of water based on the amount of available oxygen provided by the peroxyacid at a temperature below the decomposition temperature of the peroxyacid compound. The nonhydrated material is used in an amount of 50% or more based on the weight of the peroxyacid compound.

DETAILED DESCRIPTION OF THE INVENTION

The compositions of the present invention comprise several components each of which will be covered in turn below:

Peroxyacid Compound

The bleaching agent of the instant compositions is a normally solid, water-soluble/water-dispersible peroxyacid compound. A compound is "normally solid" if it is in dry or solid form at room temperature. Such peroxyacid compounds are the organic peroxyacids and water-soluble salts thereof which in aqueous solution yield a species containing a —O—O— moiety. These materials have the general formula $$HO-O-\overset{\overset{\displaystyle O}{\|}}{C}-R-Y$$

wherein R is an alkylene group containing from 1 to about 20 carbon atoms, preferably 7 to 16 carbon atoms, or a phenylene group and Y is hydrogen, halogen, alkyl, aryl or any group which provides an anionic moiety in aqueous solution. Such Y groups can include, for example, $$-\overset{\overset{\displaystyle O}{\|}}{C}-OM,\ -\overset{\overset{\displaystyle O}{\|}}{C}-O-OM \text{ or } -\underset{\underset{\displaystyle O}{\|}}{\overset{\overset{\displaystyle O}{\|}}{S}}-OM$$

wherein M is H or a water-soluble, salt-forming cation.

The organic peroxyacids and salts thereof operable in the instant invention can contain either one or two peroxy groups and can be either aliphatic or aromatic. When the organic peroxyacid is aliphatic, the unsubstituted acid has the general formula $$HO-O-\overset{\overset{\displaystyle O}{\|}}{C}-(CH_2)_n-Y$$

where Y, for example, can be $CH_3$, $CH_2Cl$, $$-\overset{\overset{\displaystyle O}{\|}}{C}-OM,\ -\underset{\underset{\displaystyle O}{\|}}{\overset{\overset{\displaystyle O}{\|}}{S}}-OM \text{ or } -\overset{\overset{\displaystyle O}{\|}}{C}-O-OM;$$

and $n$ can be an integer from 1 to 20. Diperazelaic acid ($n = 7$) and diperdodecanedioic acid ($n = 10$) are the preferred compounds of this type. The alkylene linkage and/or Y (if alkyl) can contain halogen or other noninterfering substituents.

When the organic peroxyacid is aromatic, the unsubstituted acid has the general formula

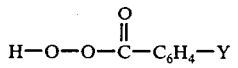

wherein Y is hydrogen, halogen, alkyl,

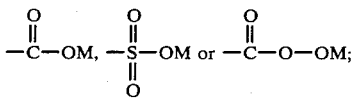

for example. The percarboxy and Y groupings can be in any relative position around the aromatic ring. The ring and/or Y group (if alkyl) can contain any noninterfering substituents such as halogen groups. Examples of suitable aromatic peroxyacids and salts thereof include monoperoxyphthalic acid, diperoxyterephthalic acid, 4-chlorodiperoxyphthalic acid, the monosodium salt of diperoxyterephthalic acid, m-chloroperoxybenzoic acid, p-nitroperoxybenzoic acid, and diperoxyisophthalic acid.

Of all the above described organic peroxyacid compounds, the most preferred for use in the instant compositions are diperdodecanedioic acid and diperazelaic acid.

The amount of the peroxyacid compound used in the present compositions is an amount sufficient to impart effective bleaching properties to the composition.

EXOTHERM CONTROL AGENT

The exotherm control agent of the present invention is a nonhydrated material which will release from about 200% to about 500% of water based on the amount of available oxygen supplied by the peroxyacid. The formation of water is the result of chemical decomposition rather than the release of water of hydration. The material should start to give up water at a temperature below the decomposition temperature of the peroxyacid compound and preferably at a temperature of from about 5° C to about 20° C below the decomposition temperature of the peroxyacid compound. The amount of available oxygen of a peroxyacid compound is determined by multiplying the number of percarboxylic groups in the compound by the atomic weight of oxygen, 16, and dividing this product by the molecular weight of the peroxyacid compound. The value derived is the fractional part of the peroxyacid which is available oxygen.

The preferred exotherm control agents of the present invention are those which release the requisite amount of water when present in an amount equal to about 50% or more of the amount of peroxyacid compound present. A preferred amount is 50% to about 400%. These levels allow for peroxyacid compound to be present at the desired levels and yet not require an inordinate amount of the exothermic control agent.

The type of material which best meets the above-mentioned requirements are acids which lose water when exposed to temperatures below the decomposition temperature of the peroxyacid compound. Such acids include, but are not limited to, boric acid, malic acid, maleic acid, succinic acid, phthalic acid, glutaric acid, adipic acid, azelaic acid, dodecanedioic acid, cis,-cis,cis,cis-1,2,3,4-cyclopentanetetracarboxylic acid, cis-1,2-cyclohexanedicarboxylic acid, hexahydro-4-methylphthalic acid, 3,3-tetramethylene glutaric acid, dihydroxymaleic acid and 3,6-dichlorophthalic acid. Preferred acids are boric acid, malic acid and maleic acid. The most preferred of these acids is boric acid. A possible way to introduce boric acid to the final mixture is to introduce borax into the wet peroxyacid compound in the presence of sulfuric acid. The borax then reacts to form boric acid which will be present in the dried peroxyacid.

Other organic and inorganic materials which meet the specified requirements are also useful herein.

OPTIONAL COMPONENTS

The bleaching compositions of the present invention can, of course, be employed by themselves as bleaching agents. However, such compositions will more commonly be used as one element of a total bleaching or laundering composition.

If compositions designed solely as bleaching products are desired, optional additional materials in the instant compositions can include pH adjustment agents, coating materials for the granules, bleach activators, chelating agents and mixtures of these type of materials. Minor components such as coloring agents, dyes and perfumes can also be present.

Typical pH adjustment agents are used to alter or maintain aqueous solutions of the instant compositions within the 5 to 10 pH range in which peroxyacid bleaching agents are generally most useful. Depending upon the nature of other optional composition ingredients, pH adjustment agents can be either of the acid or base type. Examples of acidic pH adjustment agents designed to compensate for the presence of other highly alkaline materials include normally solid organic and inorganic acids, acid mixtures and acid salts. Examples of such acidic pH adjustment agents include citric acid, glycolic acid, sulfamic acid, sodium bisulfate, potassium bisulfate, ammonium bisulfate and mixtures of citric acid and lauric acid. Citric acid is preferred by virtue of its low toxicity and hardness sequestering capability.

Optional alkaline pH adjustment agents include the conventional alkaline buffering agents. Examples of such buffering agents include such salts as carbonates, bicarbonates, silicates and mixtures thereof. Sodium bicarbonate is highly preferred.

Optional peroxyacid bleach activators as suggested by the prior art include such materials as particular aldehydes and ketones. Use of such materials as bleaching activators is described more fully in U.S. Pat. No. 3,822,114, July 2, 1974, to Montgomery, incorporated herein by reference.

Since the peroxyacid compounds used in the compositions of the present invention are subject to the loss of available oxygen when contacted by heavy metals, it is desirable to include a chelating agent in the compositions. Such agents are preferably present in an amount ranging from about 0.005% to about 1.0% based on the weight of the composition. The chelating agent can be any of the well-known agents, but certain are preferred. U.S. Pat. No. 3,442,937, May 6, 1969, to Sennewald et al., discloses a chelating system comprising quinoline or a salt thereof, an alkali metal polyphosphate, and, optionally, a synergistic amount of urea. U.S. Pat. No. 2,838,459, July 10, 1958, to Sprout, Jr., discloses a variety of polyphosphates as stabilizing agents for peroxide baths. These materials are useful herein. U.S. Pat. No. 3,192,255, June 29, 1965, to Cann, discloses the use of quinaldic acid to stabilize percarboxylic acids. This material, as well as picolinic acid and dipicolinic acid, would also be useful in the compositions of the present invention. A preferred chelating system for the present invention is a mixture of 8-hydroxyquinoline and an acid polyphosphate, preferably acid sodium pyrophosphate. The latter may be a mixture of phosphoric acid and sodium pyrophosphate wherein the ratio of the former to the latter is from about 0.2:1 to about 2:1 and the ratio of the mixture of 8-hydroxyquinoline is from about 1:1 to about 5:1.

In addition to the above-mentioned chelating systems to tie up heavy metals in the peroxyacid compositions, coating materials may also be used to extend the shelf life of dry granular compositions. Such coating materials may be in general, acids, esters, ethers and hydrocarbons and include such things as wide varieties of fatty acids, derivatives of fatty alcohols such as esters and ethers, derivatives of polyethyleneglycols such as esters and ethers and hydrocarbon oils and waxes. These materials aid in preventing moisture from reaching the peracid compound. Secondly, the coating may be used to segregate the peracid compound from other agents which may be present in the composition and adversely affect the peracid's stability. The amount of the coating material used is generally from about 2.5% to about 15% based on the weight of the peroxyacid compound.

Agents which improve the solubility of the peroxyacid product such as sodium sulfate, starch, cellulose derivatives, surfactants, etc., are also advantageously used herein. These agents can be called solubilizers and are generally used in an amount of from about 10% to about 200% based on the weight of the peroxyacid.

Such optional ingredients, if utilized in combination with the two essential components of the compositions of the instant invention to form a complete bleaching product, comprise from about 1% to about 99% by weight of the total composition. Conversely, the amount of the peroxyacid/exotherm control agent system is from about 1% to about 99% of the composition.

The bleaching compositions of the instant invention can also be added to and made a part of conventional fabric laundering detergent compositions. Accordingly, optional materials for the instant bleaching compositions can include such standard detergent adjuvants as surfactants and builders. Optional surfactants are selected from the group consisting of organic anionic, nonionic, ampholytic, and zwitterionic surfactants and mixtures thereof. Optional builder materials include any of the conventional organic and inorganic builder salts including carbonates, silicates, acetates, polycarboxylates and phosphates. If the instant stabilized bleaching compositions are employed as part of a conventional fabric laundering detergent composition, the instant bleaching system generally comprises from about 1% to about 40% by weight of such conventional detergent compositions. Conversely, the instant bleaching compositions can optionally contain from about 60% to about 99% by weight of conventional surfactant and builder materials. Further examples of suitable surfactants and builders are given below.

Water-soluble salts of the higher fatty acids, i.e., "soaps," are useful as the anionic surfactant herein. This class of surfactants includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present detergent compositions are the sodium and potassium alkyl sulfates, especially those obtained by sulfating the higher alcohols ($C_8$-$C_{18}$ carbon atoms) produced by reducing the glycerides of tallow or coconut oil; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099, and 2,477,383, incorporated herein by reference.

Other anionic surfactant compounds useful herein include the sodium alkyl glyceryl ether sulfonates, especially those ethers or higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic surfactants herein include the water-soluble salts of esters of $\alpha$-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble anionic organic surfactants herein include linear alkyl benzene sulfonates containing from about 11 to 14 carbon atoms in the alkyl group; the tallow range alkyl sulfates; the coconut range alkyl glyceryl sulfonates; and alkyl ether sulfates wherein the alkyl moiety contains from about 14 to 18 carbon atoms and wherein the average degree of ethoxylation varies between 1 and 6.

Specific preferred anionic surfactants for use herein include: sodium linear $C_{10}$–$C_{12}$ alkyl benzene sulfonate; triethanolamine $C_{10}$–$C_{12}$ alkyl benzene sulfonate; sodium tallow alkyl sulfate; sodium coconut alkyl glyceryl ether sulfonate; and the sodium salt of a sulfated condensation product of tallow alcohol with from about 3 to about 10 moles of ethylene oxide.

It is to be recognized that any of the foregoing anionic surfactants can be used separately herein or as mixtures.

Nonionic surfactants include the water-soluble ethoxylates of $C_{10}$–$C_{20}$ aliphatic alcohols and $C_6$–$C_{12}$ alkyl phenols. Many nonionic surfactants are especially suitable for use as suds controlling agents in combination with anionic surfactants of the type disclosed herein.

Semi-polar surfactants useful herein include water-soluble amide oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxides containing one alkyl moiety of about 10 to 28 carbon atoms and 2 moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivaties of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water-solubilizing group.

The instant granular compositions can also comprise those detergency builders commonly taught for use in laundry compositions. Useful builders herein include any of the conventional inorganic and organic water-soluble builder salts, as well as various water-insoluble and so-called "seeded" builders.

Inorganic detergency builders useful herein include, for example, water-soluble salts of phosphates, pyrophosphates, orthophosphates, polyphosphates, phosphonates, carbonates, bicarbonates, borates and silicates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid, and the sodium and potassium salts of ethane-1,1,2-triphosphonic acid. Examples of these and other phosphorus builder compounds are disclosed in U.S. Pat. Nos. 3,159,581; 3,213,030; 3,422,021; 3,422,137; 3,400,176 and 3,400,148, incorporated herein by reference. Sodium tripolyphosphate is an especially preferred, water-soluble inorganic builder herein.

Non-phosphorus containing sequestrants can also be selected for use herein as detergency builders. Specific examples of non-phosphorus, inorganic builder ingredients include water-soluble inorganic carbonate, bicarbonate, borate and silicate salts. The alkali metal, e.g., sodium and potassium, carbonates, bicarbonates, borates (Borax) and silicates are particularly useful herein.

Water-soluble, organic builders are also useful herein. For example, the alkali metal, ammonium and substituted ammonium polyacetates, carboxylates, polycarboxylates, succinates, and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorous builder materials (both organic and inorganic) herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Another type of detergency builder material useful in the present compositions and processes comprises a water-soluble material capable of forming a water-insoluble reaction product with water hardness cations in combination with a crystallization seed which is capable of providing growth sites for said reaction product.

Specific examples of materials capable of forming the water-insoluble reaction product include the water-soluble salts of carbonates, bicarbonates, sequicarbonates, silicates, aluminates and oxalates. The alkali metal, especially sodium, salts of the foregoing materials are preferred for convenience and economy.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, Bauman, issued Jan. 28, 1969, incorporated herein by reference.

The complex aluminosilicates, i.e., zeolite-type materials, are useful presoaking/washing adjuvants herein in that these materials soften water, i.e., remove $Ca^{++}$ hardness. Both the naturally occurring and synthetic "zeolites", especially zeolite A and hydrated zeolite A materials, are useful for this builder/softener purpose. A description of zeolite materials and a method of preparation appears in Milton, U.S. Pat. No. 2,882,243, issued Apr. 14, 1959, incorporated herein by reference.

COMPOSITION PREPARATION

The bleaching compositions of the instant invention are prepared in any conventional manner such as by admixing ingredients, by agglomeration, by compaction or by granulation. In one method for preparing the instant compositions a peroxyacid-water mixture containing from about 50% by weight to about 80% by weight of water is combined in proper proportions with the exotherm control agent and any optional components to be utilized within the bleaching granules themselves. Such a combination of ingredients is then thoroughly mixed and subsequently run thorugh an extruder. Extrudate in the form of noodles is then fed into a spheronizer (also known by the trade name, Marumerizer) to form approximately spherical particles from the peroxyacid-containing noodles. The bleaching granules can then be dried to the appropriate water content. Upon leaving the spheronizer, such particles are screened to provide uniform particle size.

Bleaching granules prepared in this manner can then be admixed with other granules of optional bleaching or detergent composition materials. Actual particle size of either the bleach-containing granules or optional granules of additional material is not critical. If, however, compositions are to be realized having commercially acceptable flow properties, certain granule size limitations are highly preferred. In general, all granules of the instant compositions preferably range in size from about 100 microns to 3,000 microns, more preferably from about 100 microns to 1,300 microns.

Additionally, flowability is enhanced if particles of the present invention are of approximately the same size. Therefore, preferably the ratio of the average particle sizes of the bleach-containing granules and optional granules of other materials varies between 0.5:1 and 2.0:1.

Bleaching compositions of the present invention are utilized by dissolving them in water in an amount sufficient to provide from about 1.0 ppm to 100 ppm available oxygen in solution. Generally, this amounts to about 0.01% to 0.2% by weight of composition in solution. Fabrics to be bleached are then contacted with such aqueous bleaching solutions.

The bleaching compositions of the instant invention are illustrated by the following examples:

EXAMPLE I

The following product is made which incorporates an exotherm control agent of the present invention:

| | |
|---|---|
| Diperoxyazelaic Acid (DPAA) | 28.2% |
| Boric Acid | 57.8 |
| Minors (Including 10% sodium sulfate) | 14.0 |

The ingredients are blended together with about an equal amount of water. After total blending has been completed, the mixture is dried to a moisture content of about 0.3%.

EXAMPLE II

The composition as described in Example I and another containing no boric acid but containing instead sodium sulfate are tested using three exotherm control tests. The exact sodium sulfate formula is shown below:

| | |
|---|---|
| Diperoxyazelaic Acid (DPAA) | 28.2% |
| Sodium Sulfate | 57.8 |
| Minors | 14.0 |

The three exotherm control tests are as follows:

1. Exposure to Flame — Five grams of the test sample are placed in a watch glass and exposed to the flame of a lighter.
2. Hot Wire Test — One pound of the test sample is placed into a $7\frac{3}{4}$ inch × $3\frac{1}{4}$ inch cylindrical cardboard tube and a thermal resistance wire passes through the bottom of a tube to expose the material to a source of heat locally.
3. Oven Test — 60 grams of the test sample are placed into an oven at 220° F and held there until decomposition is complete (approximately 1 hour). A recording is made of the temperature in the center of the sample.

The results obtained by using the above tests with the two samples are as follows:

Exposure to Flame

DPAA/Boric Acid — Does not burn.

DPAA/Sodium Sulfate — Burns rapidly.

Hot Wire Test

DPAA/Boric Acid — Only chars around wire, no smoke or flame.

DPAA/Sodium Sulfate — Smokes then bursts into flame.

Oven Test

DPAA/Boric Acid — Heats to 280° F without smoke or charring.

DPAA/Sodium Sulfate — Exotherms violently with considerable smoke and product charring.

What is claimed is:

1. A dry, granular bleach composition consisting essentially of:

(1) boric acid, and (2) a peroxyacid compound of the formula $$HO-O-\overset{\overset{\displaystyle O}{\|}}{C}-R-Y$$

wherein (a) R is selected from the group consisting of an alkylene group containing from 1 to about 20 carbon atoms and phenylene, and (b) Y is selected from the group consisting of hydrogen, halogen, alkyl, aryl, $$-\overset{\overset{\displaystyle O}{\|}}{C}-OM, -\overset{\overset{\displaystyle O}{\|}}{C}-O-OM, \text{ and } -\underset{\underset{\displaystyle O}{\|}}{\overset{\overset{\displaystyle O}{\|}}{S}}-OM$$

wherein M is selected from the group consisting of hydrogen and a water-soluble, salt-forming cation;

wherein boric acid is present in an amount of at least 50% or more of said peroxyacid.

2. A composition according to claim 1, wherein boric acid is present in an amount of about 50% to about 400% of the peroxyacid.

3. A composition according to claim 2 where the peroxyacid has the formula $$HO-O-\overset{\overset{\displaystyle O}{\|}}{C}-(CH_2)_n-Y$$

wherein Y is selected from the group consisting of $$CH_3,\ CH_2Cl, -\overset{\overset{\displaystyle O}{\|}}{C}-OM, -\underset{\underset{\displaystyle O}{\|}}{\overset{\overset{\displaystyle O}{\|}}{S}}-OM, \text{ and } -\overset{\overset{\displaystyle O}{\|}}{C}-O-OM,$$

wherein M is selected from the group consisting of hydrogen and a water-soluble, salt-forming cation, and wherein $n$ is an integer of from 1 to 20.

4. A composition according to claim 3 wherein the peroxyacid is selected from the group consisting of diperoxyazelaic acid and diperoxydodecanedioic acid.

5. A composition according to claim 4 which in addition contains from about 0.005% to about 1% of a heavy metal chelating agent.

6. A composition according to claim 5 which additionally contains from about 60% to about 99% of surfactant and builder materials, wherein said surfactant is selected from the group consisting of water-soluble organic anionic, nonionic, ampholytic and zwitterionic surfactants and mixtures thereof.

* * * * *

UNITED STATES PATENT AND TRADEMARK OFFICE

CERTIFICATE OF CORRECTION

PATENT NO. : 4,100,095

DATED : July 11, 1978

INVENTOR(S) : James Peyton Hutchins

It is certified that error appears in the above-identified patent and that said Letters Patent are hereby corrected as shown below:

Title Page, item [75], Inventors:

Delete "Donald Victor Julian, Colerain Township, Hamilton County; Michael Eugene Burns, Union Township, Butler County, all of"

Col. 2, line 29, " -O-O- " should be -- -O-O- --.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*